US006669448B2

(12) United States Patent
Beard et al.

(10) Patent No.: US 6,669,448 B2
(45) Date of Patent: Dec. 30, 2003

(54) PUMP CONTROL METHOD AND APPARATUS

(75) Inventors: Keith Beard, Worcester (GB); Paul Lewis, Redditch (GB); Steven Lycett, Warwickshire (GB); Sang Tran, West Midlands (GB)

(73) Assignee: Pulsar Process Measurement Ltd. (GB)

( * ) Notice: Subject to any disclaimer, the term of this patent is extended or adjusted under 35 U.S.C. 154(b) by 0 days.

(21) Appl. No.: 10/021,412

(22) Filed: Dec. 12, 2001

(65) Prior Publication Data

US 2002/0106280 A1 Aug. 8, 2002

(30) Foreign Application Priority Data

Dec. 12, 2000 (GB) ..... 0030205

(51) Int. Cl.[7] ..... F04G 41/06
(52) U.S. Cl. ..... 417/3; 417/12; 417/53
(58) Field of Search ..... 417/2–8, 12, 36, 417/43, 53, 62, 63, 216, 426, 504, 28

(56) References Cited

U.S. PATENT DOCUMENTS 5,135,361 A * 8/1992 Dion ..... 417/62
5,190,442 A * 3/1993 Jorritsma ..... 417/7
5,591,010 A * 1/1997 Van Zyl ..... 417/12
5,742,500 A 4/1998 Irvin

FOREIGN PATENT DOCUMENTS

| | | | |
|---|---|---|---|
| DE | 19527523 A1 | | 7/1995 |
| DE | 195 27 523 A1 | * | 1/1997 |
| FR | 2624991 | | 6/1989 |
| FR | 2 624 991 A1 | * | 6/1989 |
| GB | 2298292 | | 8/1996 |

* cited by examiner

*Primary Examiner*—Cheryl J. Tyler
*Assistant Examiner*—Han L. Liu
(74) *Attorney, Agent, or Firm*—Scott M. Oldham of Hahn, Loeser + Parks, LLP

(57) ABSTRACT

A method for controlling the operation of one or more electrically-operated pumps (11, 12) to pump a liquid from a well or sump (10) which, in use, receives a substantially continuous inflow of said liquid, characterized in that the method includes the step of starting or stopping each pump in relation to the approach of a change of tariff for the electricity supplied for the operation of each said pump (11, 12).

7 Claims, 5 Drawing Sheets

SET UP OF HIGHER TARIFF PERIODS

TIME OF THE DAY on 24 hour clock start and end setpoints

DAY OF THE WEEK

| | | |
|---|---|---|
| a) | 2 - 8 | 2 = Monday 3 = Tuesday ..... 8 = Sunday |
| b) | every | |

WEEK OF THE MONTH

| | | |
|---|---|---|
| a) | day 1 - 7 | week 1 |
| b) | day 8 - 15 | week 2 |
| c) | day 16 - 23 | week 3 |
| d) | day 24 - 31 | week 4 |
| e) | last | |
| f) | every | |

Fig. 4

PERIOD OF THE YEAR

| | | |
|---|---|---|
| Higher Tariff | start period | DD/MM |
| Higher Tariff | end period | DD/MM |

PUMP CONTROL METHOD AND APPARATUS

TECHNICAL FIELD

This invention relates to a method for controlling the operation of one or more pumps and to apparatus for carrying out such a method. Although the present invention will be described herein with particular reference to the operation of electrically controlled pumps in a pumping-station, it is not to be construed as being limited thereto. The method and apparatus of the present invention is applicable to any situation in which pumps are used to remove liquid from a vessel in response to an increase in the level of the liquid within said vessel.

BACKGROUND OF THE INVENTION

A typical pumping-station comprises a plurality of wells or sumps, each well or sump having an inlet to admit liquid thereto and an outlet to remove liquid therefrom. Each outlet is associated with one or more pumps which, in use, transfer the liquid from the well or sump for further processing.

The price of the electricity used to operate the pumps is a significant factor in the cost of running a typical pumping-station. Seasonal (or even daily) variations in tariff costs are implemented by electricity supply companies. It is therefore highly desirable, when operating pumps, to optimise pumping during low-tariff periods and to avoid pumping as much as possible during higher-tariff periods, with the proviso, however, that overflow from the well or pump should if at all possible be avoided.

It may also be required to minimise pumping during certain periods, to avoid noise disturbance caused by the operation of the pumps. For the purpose of the present invention, the period in which it is necessary to avoid the use of the pumps to minimise noise disturbance may be considered to be the same as a higher-tariff period, since the net effect on the operation of the pumps is the same.

Although several methods of controlling the operation of pumps in a pumping-station so as to minimise the consumption of higher-tariff electricity are known (for example GB-B-2298292), such known methods have tended to require a more or less complicated system of plural "on-off" pumping points and/or means to determine the pumping-rate and running-time of each pump used.

SUMMARY OF THE INVENTION

The present invention provides a method of controlling pumps which is based upon the anticipation of a change in the price of the electricity required to operate the pump and which proactively manages the level of the liquid to the optimum, at times of tariff-change.

Accordingly, the present invention provides a method for controlling the operation of one or more electrically-operated pumps to pump a liquid from a well or sump which, in use, receives a substantially continuous inflow of the liquid, wherein the method includes the step of starting or stopping each pump in relation to the approach of a change of tariff for the electricity supplied for the operation of each pump.

Preferably, the method of the present invention includes the steps of providing the customary single set of "start" and "stop" points for the pumps associated with each said well or sump and, before actuating the pumps at the "start" point or stopping the pumps at the "stop" point, determining the time required to empty and subsequently to refill the well or sump at the current inflow rate and comparing said time with the time remaining before said change of tariff.

For example, if the approaching change of tariff is positive (i.e. the cost of the electricity is about to increase), it is desirable to empty the well or sump completely, prior to the change.

Alternatively, if the approaching change of tariff is negative (i.e. the cost of the electricity is about to decrease), it is desirable for the well or sump to be allowed to fill to an increased level immediately prior to the change.

The present invention also provides apparatus for carrying out the method hereinabove described, the apparatus comprising a well or sump which, in use, receives a substantially continuous inflow of a liquid. The well or sump having an outflow for the liquid and one or more electrically operated pumps associated with the outflow. The well or sump is provided with a single set of "start" and "stop" points for the pumps, and further comprising means to determine, at the "start" point and at the "stop" point, the time required to empty and subsequently to refill the well or sump and to compare the time with the time remaining before a change of tariff for the electricity supplied for the operation of each pump.

The present invention will be illustrated, merely by way of example, in the following description and with reference to the accompanying drawings.

BRIEF DESCRIPTION OF THE DRAWINGS

FIG. 4 is a typical set-up menu for use in connection with the present invention.

DETAILED DESCRIPTION OF THE INVENTION

Figure 1:
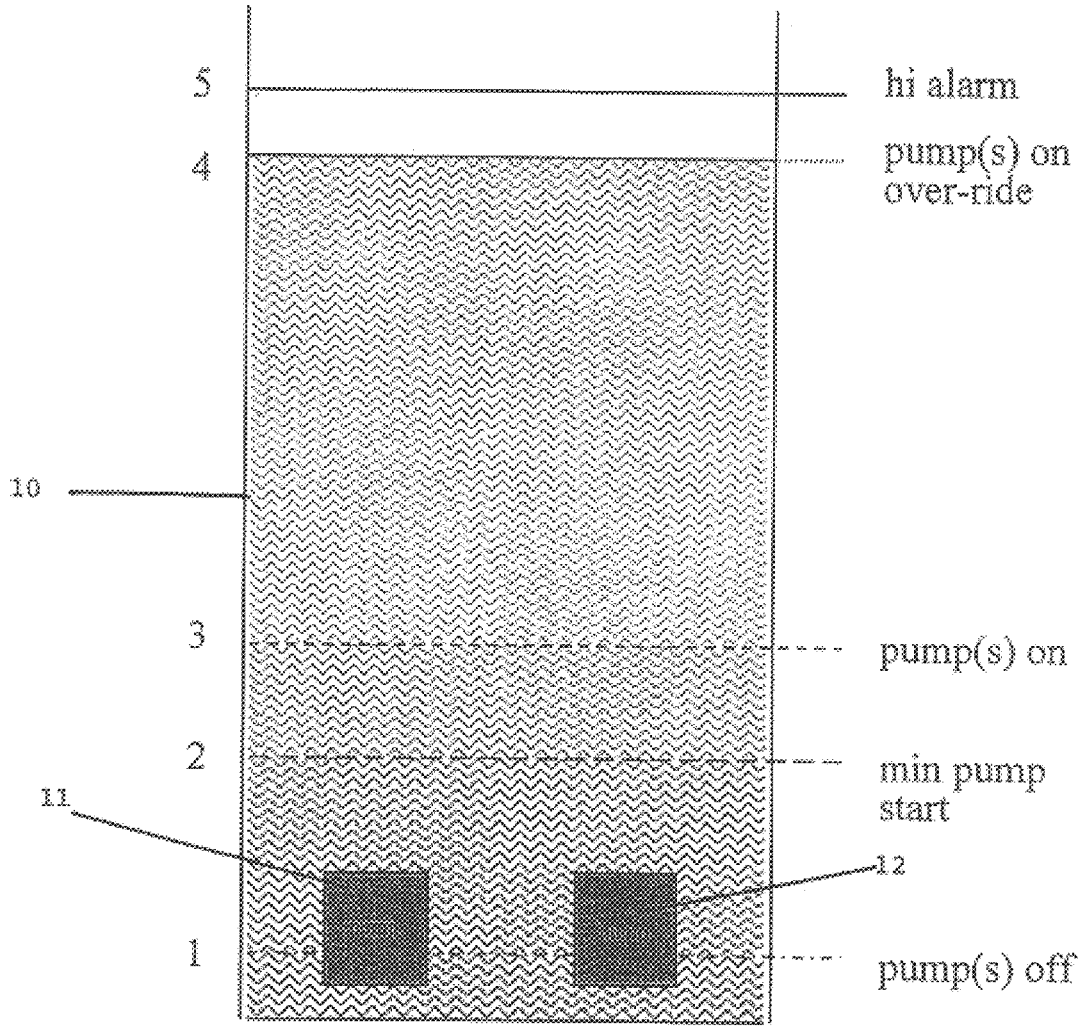
FIG. 1 is a schematic representation of a well or sump to which the method of the present invention is to be applied.

Referring to FIG. 1, there is shown a sump (10) having two pumps (11 and 12) operatively associated therewith.

FIG. 1 shows the points at which a pump is switched on (3) and switched off (1). There is also present a "high-level" alarm (5) which is initiated from the system in the event of high liquid level. Also illustrated in FIG. 1 is the minimum start level (2)—this is the minimum level of liquid required to prime the pumps and enable them successfully to pump out liquid. Level (4) is a pump on over-ride. This is the level at which, irrespective of the control sequence in operation, the appropriate pumps will be switched on in order to draw down the liquid level. During normal operation, the pump is switched on at level (3) and off at level (1). Variation of the sequencing of the pumps may be initiated, within the scope of the present invention.

In this example, we have considered a maximum of three different tariff levels occurring during the period of a typical day in winter and the effect of those levels on the associated supply of electricity to pumps in a pumping-station. For completeness, a corresponding tariff variation (showing only two tariff periods) is also shown illustrating a typical summer day (or alternatively a noise-avoidance period, which may be required at any time of year).

Figure 2:
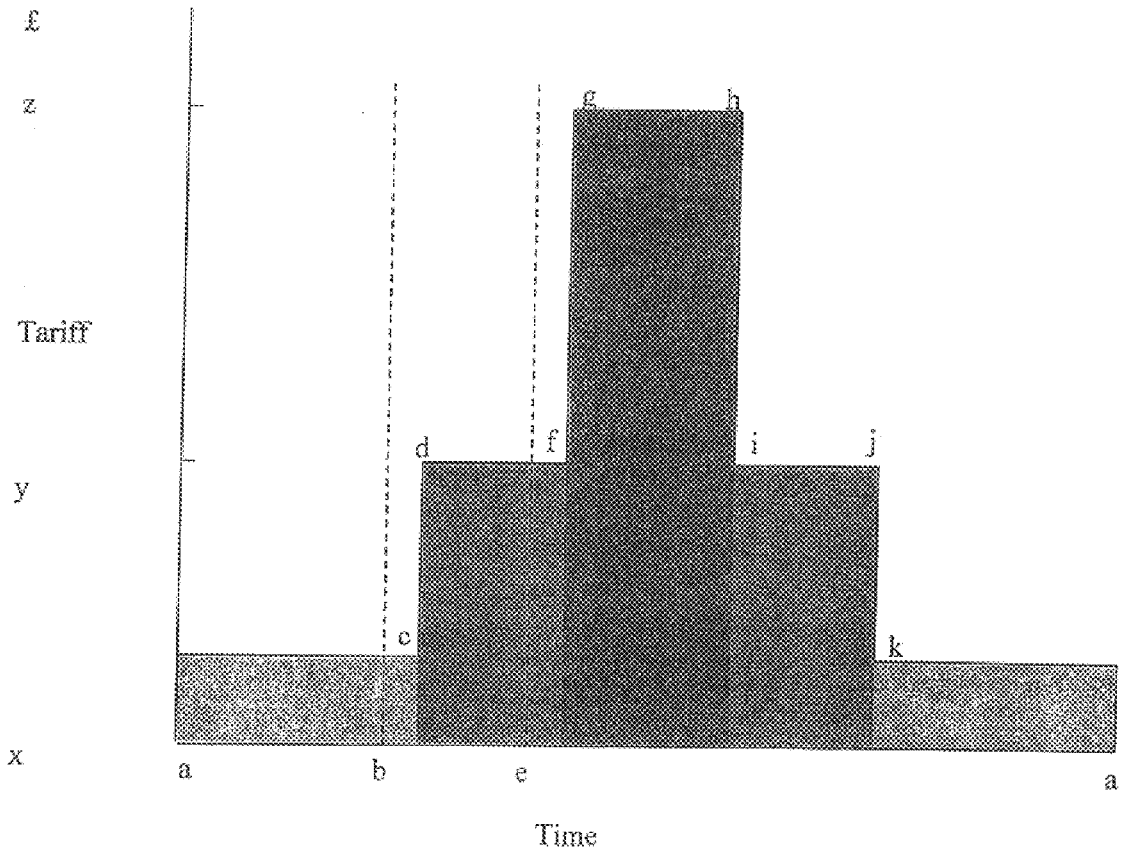
FIG. 2 is a schematic representation of change in winter electricity tariffs with respect to time.
Figure 3:
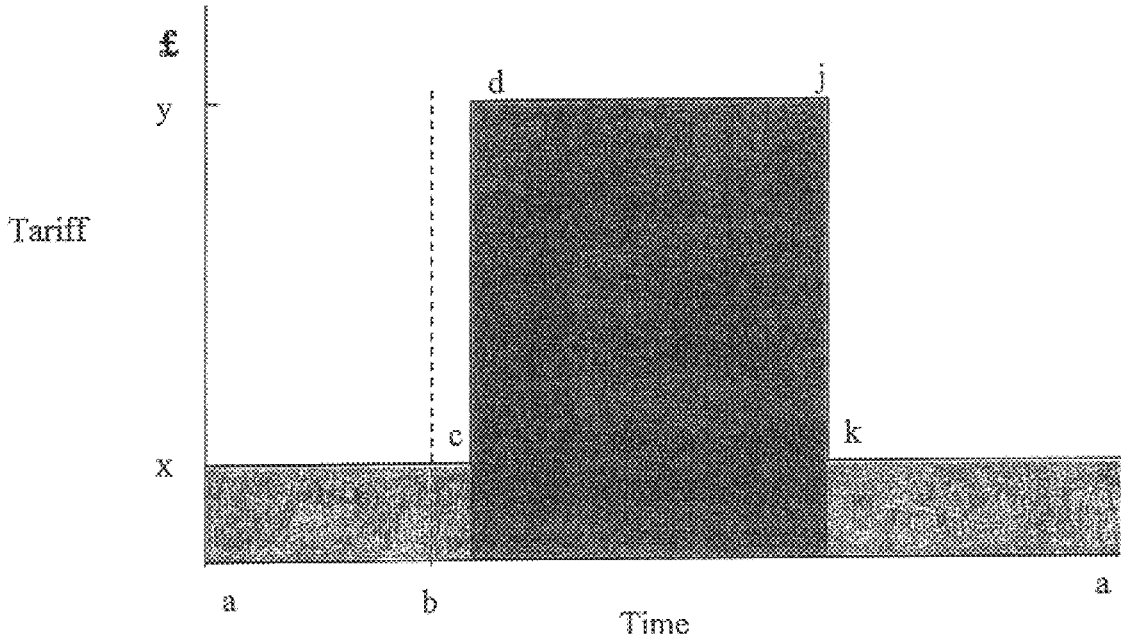
FIG. 3 is a schematic representation of change in summer electricity tariffs with respect to time.

Referring to FIGS. 2 and 3, periods A–C and K–A are the lowest cost tariff periods (X). Periods D–J (summer), D–F and I–J (winter) illustrate the next highest rate of tariff charge (Y) and periods G–H illustrate the highest tariff period (Z) which may represent a substantially higher cost of electricity, and which is sometimes called a triad period.

The tariff periods are programmed into a PULSAR level-control unit by means of a set-up menu as shown in FIG. 4. The unit monitors a period of 48 hours in advance of the current time registered on its internal real time clock and a period of 24 hours in arrears of that time. If no changes in tariff occur during this monitored period, the pumps operate in the normal way between levels (1) and (3). If, however, there is to be a change in tariff cost (as illustrated by C–D, F–G, H–I, J–K) during the next 48-hour period, the unit causes the pumps to operate in the following manner:

At the end of each pumping cycle, the pumps are switched off. The inflow to the sump then causes the liquid level to rise. The volume of inflow of liquid to the sump is then determined and compared to the capacity of the sump to contain the inflow of liquid that will occur between the determination time and the time at which the next tariff change will occur. The unit will then operate the pumps according to one of the following three options, with the proviso that in no circumstances will a pump be run unless the level of liquid is above the minimum start level (2).

Option I: If the capacity of the sump is not sufficient to contain the liquid at the current inflow rate, the pump will pump in the normal way, switching on at 3 and off at 1. Before actually switching on the pump in this case, the unit will calculate whether there is enough time to refill the well before the next tariff change. This is done by calculating the time required to pump the sump empty to level (1) and to refill the sump to level (3), at the current inflow rate. If this time period is in excess of the time required to reach the next tariff change and the capacity of the sump at the required level is sufficient to contain the inflow of liquid that will occur prior to the next tariff change, then instead of pumping the sump down to the empty level (1) the unit will operate the pumps according to Option II: not switch the pump on at level (3) but instead store the liquid within the sump, utilising the full capacity of the sump if necessary. If, however, the capacity of the sump at the required level is not sufficient to contain the liquid inflow that will occur prior to the next tariff change, the system will operate according to Option III: pump the sump down to a level which provides enough capacity in the sump to contain the liquid inflow that will occur in the period of time remaining before the next tariff change. The time that the pump is run under these circumstances is at least equal to or longer than the minimum pump run time. (The minimum pump run time is the time designated as the minimum time it is desirable for any pump to run—this will vary according to the type of pump design, is user definable and is used to prevent excessive wear and tear to the pump or to prevent pump(s) from hunting.)

Figure 5:
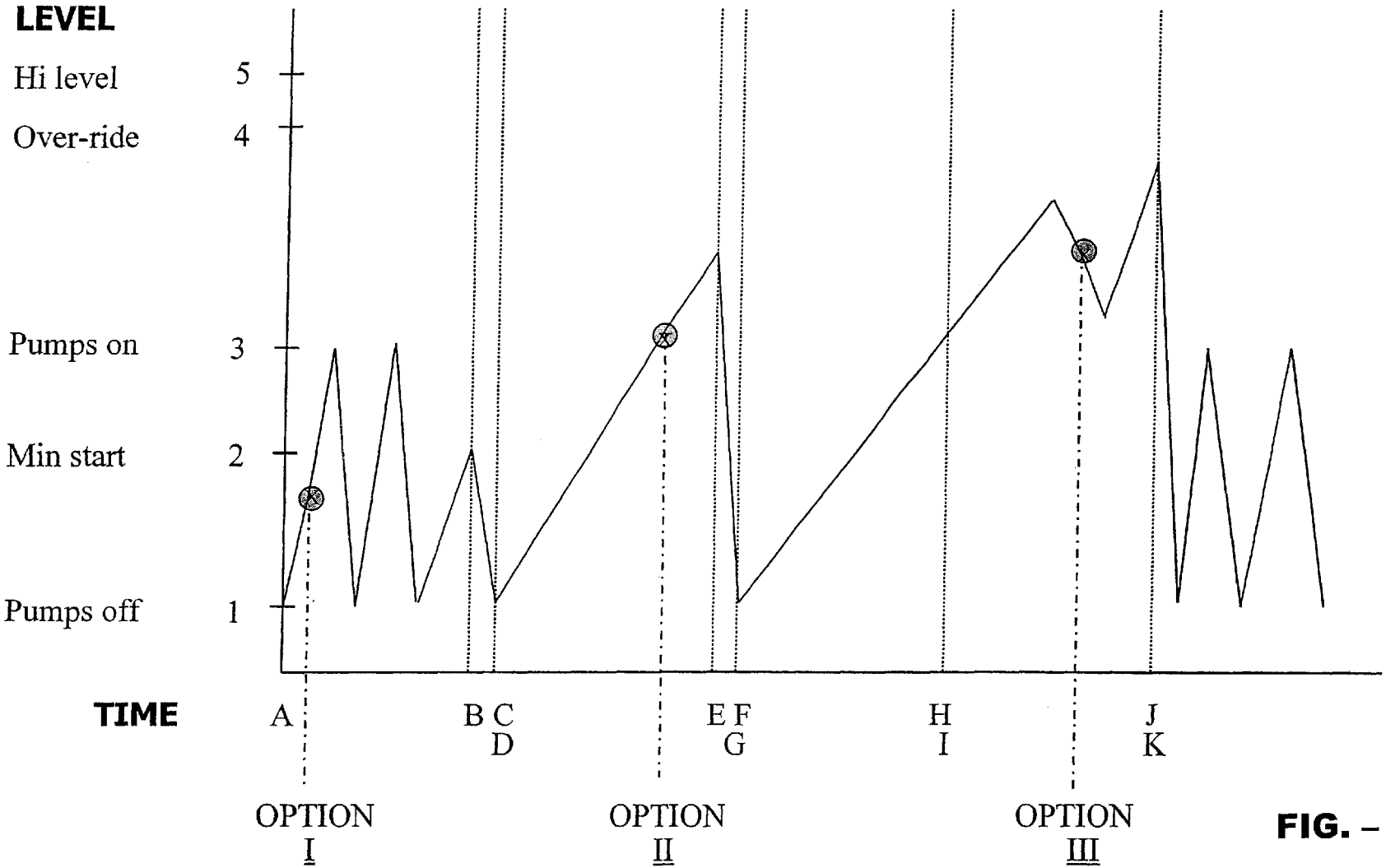
FIG. 5 is a schematic representation of change in liquid levels with respect to time, as applied to the well or sump shown in FIG. 1.

These sequences are illustrated in the plot of level against time as shown in FIG. 5, viewed in conjunction with FIG. 1 and FIG. 2.

First Positive Tariff Changes

If the next tariff change is positive, i.e. the tariff charge increases, it is desirable to empty the sump completely prior to the increase in tariff rate, thus providing maximum storage capacity available to be filled by the inflow during the higher tariff period. Therefore, in anticipating this positive change in tariff, a point in time illustrated for example as B or E on FIG. 2, can be determined. This is the point in time at which the level must be optimised to be at the pump start level 3 or at least above the minimum pump start level (2) and thus provides enough time, B–C or E–F, to allow the well to be pumped completely empty prior to the positive tariff change to a higher cost. In the case of the first positive tariff change this situation is achieved utilising Option I or Option III described above. The periods B–C and E–F are called the pump "lead times". During this period pump 1 will be switched on whilst the level is at any point between level (2) (minimum start level) and level (3) (pump on level) and the sump emptied. All other pumps will operate at their normal start and stop points during the pump lead-time.

If the level in the sump were not optimised to the pump start level (3) at B or E it might be that there is not enough liquid within the sump to achieve the minimum pump start level and therefore enable the system to commence pumping to achieve an empty sump prior to the positive tariff change in this manner. The system therefore ensures that at points D and G the higher tariff is commenced with a completely empty sump.

Subsequent Positive Tariff Changes

For subsequent positive tariff changes the system optimises the level to be at any point above (2) the minimum start level at the commencement of the pump lead time and may use the full capacity of the sump employing Options I, II or III.

Negative Tariff Changes

Conversely at negative tariff changes, illustrated on FIG. 2 at points H and J, it is desirable, since the cost of electricity is falling rather than increasing, to have a full sump ready to be pumped out at lower cost after the change to a lower tariff level H–J or J–K has occurred. In this case the system optimises the contents of the sump by utilising Options II or III described above and using the extra capacity between levels (3) and (4), calculated from the liquid inflow such that, at points H and J a full sump is achieved and maximum saving is made by emptying at a lower tariff after the electricity cost reduction has occurred.

Once a negative tariff change has occurred the system will continually assess the level and the inflow rate and calculate if the capacity of the sump is great enough to contain the liquid inflow until even the next lower tariff. If enough capacity is available it will continue to reassess the situation but postpone pumping until any or the final subsequent lower tariff band is reached.

If during any tariff period the rate of inflow changes substantially and unexpectedly, for instance during storm conditions, such that the capacity of the sump will be exceeded and high alarm activated, the sequence of pump operation is placed on override as soon as level 4 is predicted and confirmed to be exceeded, the sump is then pumped down to the normal pump off points.

Whenever the lowest tariff band is reached the system will resume normal running and a period of time called the pump lag time is implemented. This period is initiated immediately after a lower tariff period has been commenced and in the event that pumping down from a level in excess of the normal start point (3) is required. During the duration of the pump lag time or until the sump has emptied to the off point (1) only one pump is allowed to be switched on thus keeping pumping costs to a minimum. However, if the liquid inflow is unusually high and the level is still above the pump start point (3) after the expiry of the pump lag time, further pumps will be switched on as required by their normal individual start level programs.

Although preferred embodiments of the invention have been described herein, various modifications or variations will be apparent to one skilled in the art without departing from the principles and teachings herein. Accordingly, the invention is not to be limited to the specific embodiments illustrated, but is only intended to be limited by the scope of the appended claims.

What is claimed is:

1. A method for controlling the operation of one or more electrically-operated pumps to pump a liquid from a well or sump which, in use, receives a substantially continuous inflow of said liquid, wherein the method includes the steps of:

providing a single set of "start" and "stop" points for the pumps associated with each said well or sump;

determining the time required to empty and subsequently to refill the well or sump at the current inflow rate before activating the pumps at the said "start" point or stopping the pumps at the said "stop" point;

comparing said time with the time remaining before a change of tariff for the electricity supplied for the operation of each said pumps occurs; and overriding said "start" or "stop" points and starting or stopping each pump in relation to the approach of said change of tariff to achieve a predetermined liquid level in well or sump relative to said change in tariff.

2. A method as claimed in claim 1, in which said starting of the one or more pumps results in the complete emptying of the well or sump prior to said change when said change of tariff is positive.

3. A method as claimed in claim 1, which at least said starting or said stopping of the one or more pumps results in an maximum liquid level within the well or sump prior to said change when said the change of tariff is negative.

4. Art apparatus for controlling the operation of one or more electronically-operated pumps to pump a liquid from a well or sump which, in use, receives a substantially continuous inflow of said liquid, comprising:

at least one electrically-operated pump associated with said outflow, a control system wherein said at least one pump is provided wit a single set of "start" and "stop" points the control system used to determine, at said "start" point and at said "stop" point, the time required to empty and subsequently to refill said well or sump and to compare said time with the time remaining before a change of tariff for the electricity supplied for the operation of said at least one pump, and used to override at least said on point or said off point to achieve an empty or full well or sump immediately prior to said change in tariff.

5. A method for controlling the operation of one or more electrically-operated pumps to pump a liquid from a well or sump comprising:

providing a predetermined pump on point and off point; and overriding said on point and said off point based on a current inflow rate of liquid into the well or sump, a current liquid level in the well or sump, a subsequent change in tariff for the supplied electricity to run the pumps, and the time remaining before said change in tariff wherein said revised pump on and off points provide for a substantially minimum or maximum liquid level prior to said change in tariff.

6. A method as claimed in claim 5, in which said overriding of said points provides a maximum liquid level immediately prior to said change in tariff when said change results in a tariff reduction.

7. A method as claimed in claim 5, in which said overriding of said points provides a minimum liquid level immediately prior to said change in tariff when said change results in a tariff increase.

* * * * *